United States Patent [19]

Davidson

[11] 4,364,258

[45] Dec. 21, 1982

[54] HOLDER FOR HYDRAULIC SWAGING TOOL

[76] Inventor: Peter Davidson, 1655 Fair Ct., Grosse Pointe, Mich. 48236

[21] Appl. No.: 278,187

[22] Filed: Jun. 29, 1981

[51] Int. Cl.[3] ..... B21J 9/12

[52] U.S. Cl. ..... 72/453.15; 29/237

[58] Field of Search ..... 72/453.02, 453.01, 453.15, 72/453.16, 402; 29/237, 517

[56] References Cited

U.S. PATENT DOCUMENTS

| | | | |
|---|---|---|---|
| 2,165,504 | 7/1939 | Pfauser | 72/453.15 |
| 2,182,663 | 12/1939 | Eby | 72/453.15 |
| 2,255,985 | 9/1941 | Pfauser | 72/453.15 |
| 2,381,748 | 8/1945 | Howe | 29/237 |
| 3,879,834 | 4/1975 | Johnson | 29/237 |

*Primary Examiner*—Gene Crosby

*Attorney, Agent, or Firm*—Cullen, Sloman, Cantor, Grauer, Scott & Rutherford

[57] ABSTRACT

A holder for a hydraulic swaging tool has a base having an upstanding anchor bracket at one end thereof. A manually actuated hydraulic pump includes a cylindrical body at one end secured to the bracket with its other end bearing upon the base and a pump outlet. A clamp assembly on the opposite end of the base on one side thereof includes a saddle and an overlying pressure cap, each with opposing semi-circular surfaces, receiving a resilient transverse sleeve. A swaging tool with a pressure fluid inlet is axially nested in the sleeve and is frictionally gripped within the clamp assembly. A conduit interconnects the pump outlet and the swaging tool inlet.

9 Claims, 5 Drawing Figures

FIG. 1
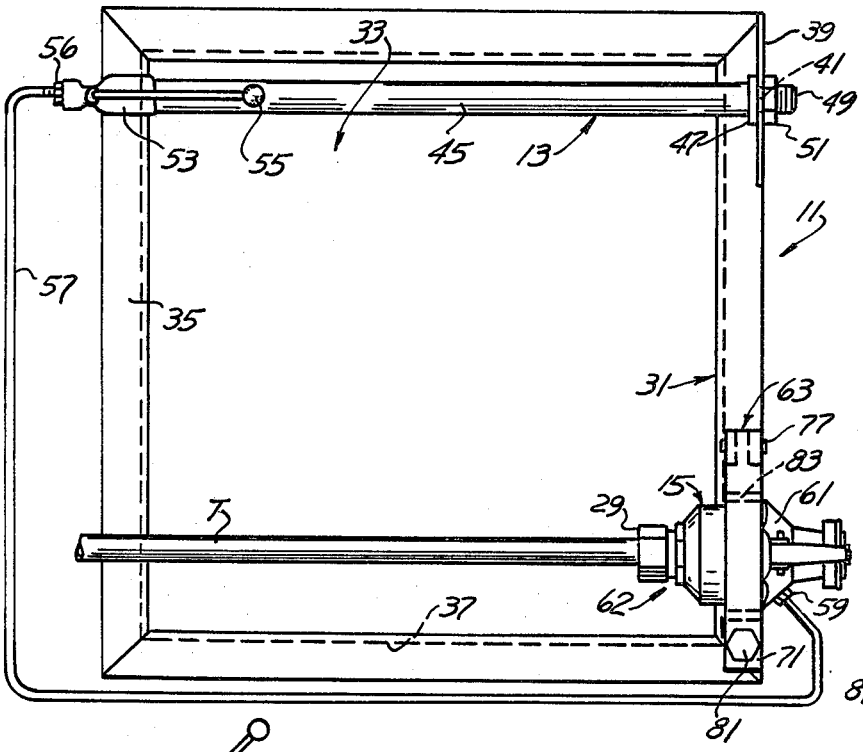
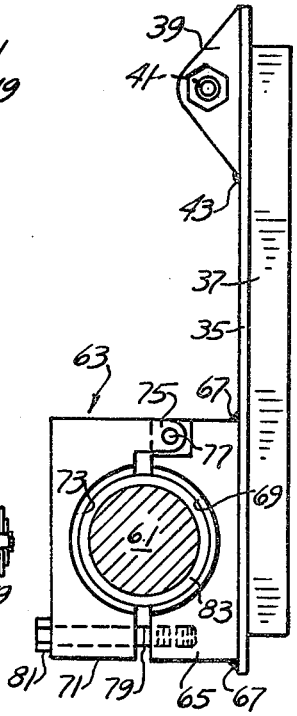
FIG. 3
FIG. 2
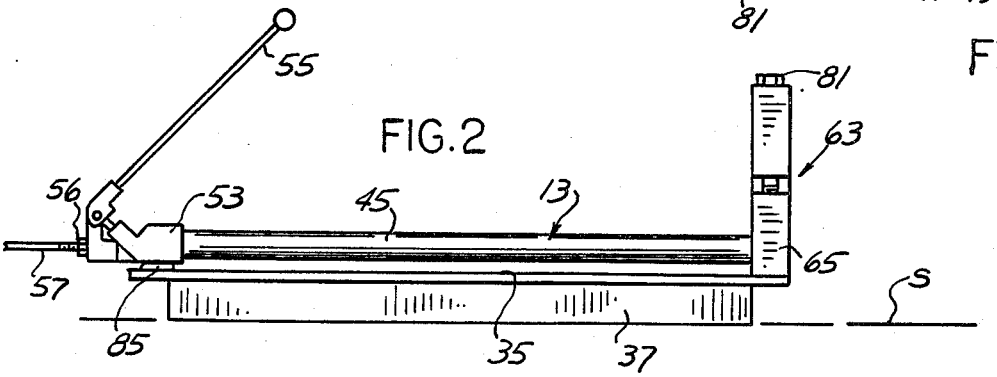
FIG. 4
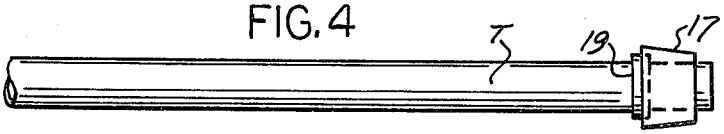
FIG. 5
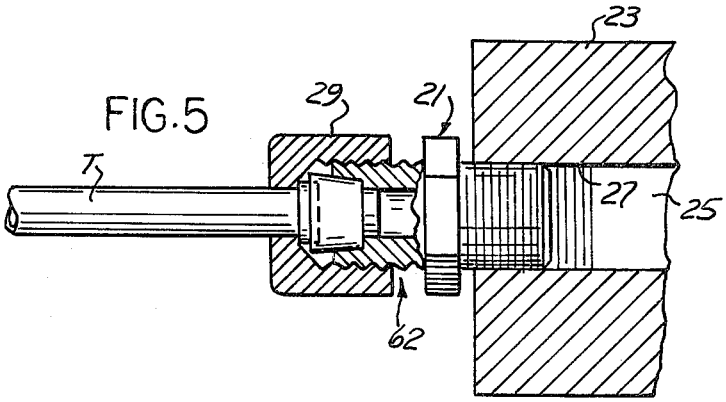

HOLDER FOR HYDRAULIC SWAGING TOOL

BACKGROUND OF THE DISCLOSURE

Heretofore in providing tubing adapted for connection and sealing to a pressure fitting connected to some part of a tool or machine adapted for delivering fluids, the problem has existed of swaging onto the conduit adjacent one end thereof conventional fitting elements, such as tapered ferrule and a sealing ring, in order to be sealingly received and engaged by an assembly nut for connecting the tube to the conventional tube fitting.

Various types of tools have been provided by which the sealing assembly including the ferrule and sealing ring are in one manner or another swagingly secured over and adjacent one end of the tubing.

One conventional method of accomplishing the swaging operation for the sealing fittings and assembly fittings for use in conjunction with the tube fitting is to employ a conventional swaging tool which has a cylindrical body, a pressure fluid inlet fitting and upon one end thereof a swaging head into which the tube onto which a part is to be swaged is projected.

There is also provided in a kit a conventional manually operated hydraulic pump which has an elongated cylinder, an operating handle and a pressure fluid outlet. In normal operation a flexible tubing interconnects the pump outlet and the swaging tool inlet in order to provide sufficient hydraulic pressure for the swaging tool operation of the swaging head. Parts to be swaged together are axially projected into and retained within said head.

As is conventional, some form of anchoring the hydraulic manually operated power cylinder and the swaging head had been employed for securing the parts to a table or other support. Conventionally a series of C clamps have been employed for this purpose.

The problem with existing use of C clamps or other means for anchoring the two parts of the hydraulic swaging tool assembly onto a table is the difficulty of effectively anchoring the respective parts to the table so that they be ready for immediate use from time to time for swaging parts onto tubes, and particularly the parts employed with hydraulic pressure fittings or other fittings used in conjunction with the delivery of pressure fluids to passages within the body of a tool or other part.

SUMMARY OF THE INVENTION

An important feature of the present invention is to provide an improved holder for the hydraulic swaging tool assembly which is of a substantial unit construction which is mountable upon a support surface stationarily thereon and which holder has a bracket thereon for axially anchoring and mounting the manually operable hydraulic cylinder and further has spaced therefrom upon said base a clamp assembly within which the swaging head is frictionally retained and supportably mounted.

This leaves the user's hands free for manually activating the hydraulic pump and for manually projecting and holding the tubing and part to be swaged thereon within the swaging head for the swaging operation.

In swaging tools of this type the manually operable cylinder provides pressurized fluid to the body of a swaging tool to affect the hydraulic operation thereof including the swaging head. An important feature of the present invention provides an improved and simplified holder by which respective parts which make up the swaging tool assembly may be anchored and supported within the holder and ready for use at times and at all times interconnected so that pressurized fluid is instantly available to the swaging head upon pumping action applied to the pump mounted upon the holder.

A further feature includes an improved clamp assembly, of a simplified form wherein there is provided a saddle secured upon the base or framework having an upwardly opening semi-circular recess and loosely thereover a pressure cap having a downwardly facing semi-circular recess wherein a resilient tube is transversely positioned between said saddle and pressure plate and is adapted to frictionally and retainingly receive the body of a swaging tool.

A further feature is to provide an improved and simplified clamp assembly adapted to loosely and resiliently receive the swaging tool body and for frictionally retaining the body upon the holder with the swaging head thereof facing inwardly of the holder so as to be conveniently accessible to the user who projects a tube onto which a fitting is to be swaged for easily projecting the tube and part into the swaging head hoilding the same and at the same time applying pressurized hydraulic fluids to the swaging head through activation of the hydraulic pump.

These and other objects will be seen from the following specification and claims in conjunction with the appended drawing.

THE DRAWING

FIG. 1 is a plan view of the present holder for a hydraulic swaging tool assembly with the swaging tool components mounted and secured thereon.

FIG. 2 is a front end elevational view thereof.

FIG. 3 is a right side elevational view thereof.

FIG. 4 is a fragmentary side elevational view of a tube onto which a pair of parts are to be swaged utilizing the present swaging tool of FIG. 1

FIG. 5 is a similar view of the tube with the sealing parts swaged thereon and employed in a conventional assembly with an assembly nut and pressure fitting by which the tube with swaged parts is secured with respect to a passage within the part to which the tube is connected.

DETAILED DESCRIPTION OF AN EMBODIMENT OF THE INVENTION

Referring to the drawing, the present hydraulic swaging tool holder is generally indicated at 11, FIG. 1 and includes a hydraulic pump 13, a hydraulic swaging tool 15 adapted for swaging of parts such as ferrule 17 and sealing ring 19 upon tubing T used in industrial applications with connections to parts, machinery for the transmission of fluids thereto. The tubing may be of copper, aluminum, steel or stainless steel.

The parts 17 and 19 in the illustrative embodiment are adapted for swaging onto an end portion of the tube T, FIG. 4 and are adapted for connection to a conventional tube fitting 21 having a threaded body adapted for threaded engagement within the threaded portion 27 of the bore 25 within a machine part or other product 23.

The aforesaid ferrule 17 and sealing ring 19, or other part adapted to be sealingly secured over the tube T is adapted to receive the assembly nut 29 which in turn cooperatively receives the opposite end of the tube fitting 21 shown in FIG. 5.

This therefore shows the environment in which the swaged parts 17 and 19 onto the Tube T are employed for illustration.

The foregoing hydraulic swaging tool holder including the hydraulic pump 13, the swaging tool 15 and certain other related parts are available on the market and sold by Crawford Fitting Company, 29500 Solon Road, Solon, OH 44139.

The present invention is directed to an improved holder for use with and in combination with the present hydraulic swaging tool and particularly the hydraulic pump 13 and the swaging tool 15 shown in FIG. 1.

While in use, heretofore the hydraulic swaging tool elements are anchored to a support as by C clamps or other means. The present invention is directed to a holder mechanism particularly adapted for use in conjunction with the present hydraulic swaging tool elements including the hydraulic pump 13, the swaging tool 15 and the connecting tubing 57.

The present holder 11 includes a base 31 which in the illustrative embodiment is hollow and has a central rectangular aperture 33 defined by the continuous right angularly related top flanges 35, FIGS. 1, 2 and 3 which provide a support or mount for the respective hydraulic pump and swaging tool.

The present base includes depending from said top flange, a continuous and peripheral vertical flange 37 which defines a supporting leg for the base 31 and is adapted for mounting upon a suitable support surface as shown at S, FIG. 2.

Upon one side of the base and at one end of the corresponding top flange 35 there is arranged anchor bracket 39 transversely apertured at 41 and secured to the top flange as by the welds 43. The hydraulic pump 13 includes the elongated cylinder 45 with a head 47 at one end terminating in exteriorly threaded mount boss 49.

The cylinder is adapted to overlie the base 31 with the mount boss 49 projected through anchor bracket 39, with suitable washers interposed and not shown, and secured in position by the threaded fastener 51 in operative engagement with one side of said anchor bracket. It is contemplated that other means may be employed for securing the cylinder at its one end to said anchor bracket.

The hydraulic pump has a pump piston assembly 53, FIGS. 1 and 2, which includes the manually operable actuator rod 55 having a suitable handle which is adapted for movement in a vertical plane relative to the support S. The piston pump assembly at an end thereof opposite from its mounting to the anchor bracket has a pressure fluid outlet 56 to which there is connected one end of the pressure fluid conduit 57.

The present swaging tool 15 includes swaging tool body 61 having a pressure inlet fitting 59 to which is connected the opposite end of the conduit 57 adapted for delivering pressurized fluid to the swaging tool for effecting operation of its swaging head 62.

Mounted upon one end of the base 31 upon the same top flange 35 which mounts the anchor bracket 39 is the clamp assembly 63, FIG. 3.

The clamp assembly includes a saddle 65 secured to the base as by the welds 67 which includes in its top surface an upwardly opening semi-circular transverse recess 69. The clamp assembly also includes pressure cap 71, which overlies the saddle, is normally spaced therefrom as at 79 and includes a downwardly opening semi-circular transverse recess 73, FIG. 3.

The present clamp assembly includes means for adjustably connecting the pressure cap to the saddle with respect to the transverse rubber sleeve 83 projected therethrough.

The body 61 of the swaging tool is normally nested within the rubber sleeve 83 and in view of the clearance 79 between the clamp assembly parts shown in FIG. 3 provides a means by which the swaging tool body may be frictionally and retainingly supported and secured upon the base 31.

While in the illustrative embodiment, sleeve 83 has been referred to as a rubber sleeve, is contemplated as equivalent that the sleeve could be neoprene, plastic, rubber or PVC, for illustration.

In the illustrative embodiment, the present hydraulic pump includes at the end opposite from its mounting to the anchor bracket, a depending foot or feet 85 as shown in FIG. 2 and is in supported engagement with a portion of the top flange 35 upon the side of the base opposite from that portion of the base flange which mounts the anchor bracket and the clamp assembly.

In the arrangement shown for the mounting and anchoring of the hydraulic pump and the swaging tool upon the holder including the base 31 thereof, the axis of the hydraulic pump and swaging tool are parallel and spaced, FIG. 1.

In use, tube T, as shown in FIG. 4 with the sealing parts 17 and 19 loosely mounted thereon, the tubing fragmentarily shown in FIG. 1, and such parts are axially projected into the swaging head 62 and held for the swaging operation as by assembly nut 29 threaded onto said head.

This is accomplished by the manually pumping with the other hand the actuator 55 for the hydraulic pump until sufficient hydraulic pressure fluid is directed to the pressure fitting 59 of the swaging tool body such as will effectively actuate the swaging head 62 for the swaging operation which itself is conventional.

The base 31 for the present hydraulic swaging tool holder includes a plurality of right angularly related angle members suitably secured together to define the continuous peripheral top support flange 35 and the continuous vertical flange 37 which upon the interior thereof defines the sides of the rectangular opening 33 within said base.

In the illustrative embodiment of the invention, one form of anchor clamp is shown. It is contemplated that other types of anchor clamps could be employed which accomplish the function primarily of effectively retaining and anchoring the swaging tool body upon the base 31 of holder 11.

In use at a factory or plant, the respective parts, namely the hydraulic pump 13 and the swaging tool 15 are retained and secured upon the present holder with the conduit 57 connected as shown so that it is ready at any time for a swaging operation.

In the illustrative embodiment of the clamp assembly construction, the pressure cap 71 at one end has a pair of depending flanges 75 which bear against one end of the saddle 65 and are pivotally mounted thereon as by the pivot bolt 77. In the illustrative embociment the opposite end of the pressure cap includes the downwardly depending fastener 81 which is threaded into the saddle, FIG. 3. On tightening of the fastener 81, the pressure cap is drawn towards the saddle 65. The resilient sleeve 83 is interposed and in view of the clearance 79 provides a means by which the clamp assembly is adapted to frictionally and retainingly engage the swaging tool body for securing the same in positions as shown in FIG. 1.

Having described my invention reference should now be had to the following claims:

I claim:

1. A holder for a hydraulic swaging tool comprising a base;

an upright anchor bracket upon and at one end of said base on one side thereof, having a mount aperture therethrough;

a manually actuated hydraulic pump having an elongated cylindrical body, a mount boss projecting axially of one end of said body projected through said anchor bracket and secured thereto;

said body overlying said base and at its other end supported upon said base on the opposite side thereof;

said pump having a pressure fluid outlet;

an upright clamp assembly upon and at the opposite end of said base on said one side thereof;

said clamp assembly including a saddle upon and secured to said base having an upwardly opening semi-circular slot;

a pressure cap overlying and spaced above said saddle having a downwardly opening semi-circular slot;

a resilient sleeve extending through said clamp assembly and nested within said saddle and pressure cap;

a swaging tool having a cylindrical body and having a pressure fluid inlet and a swaging head, said tool body axially nested within said sleeve and clamp assembly;

means for adjustably securing said pressure cap to said saddle frictionally anchoring said swaging tool body;

and a conduit fluidly interconnecting said pump outlet and said swaging tool inlet.

2. In the holder of claim 1, said base being hollow and including interconnected angle members defining a peripheral top support flange and a continuous vertical flange mountable upon a support.

3. In the holder of claim 1, said hydraulic pump mount boss being threaded, and a fastener threaded over said mount boss operatively engaging said anchor bracket.

4. In the holder of claim 1, said pump including a pump arm manually pivotal in a vertical plane, said pump being anchored upon said base.

5. In the holder of claim 1, said securing means including said pressure cap at one end being pivotally mounted upon one end of said saddle;

and a fastener extending through the other end of said cap and adjustably threaded into said saddle.

6. A holder for a hydraulic swaging tool comprising of a hollow base including a plurality of angle members defining a continuous peripheral top support flange and a continuous vertical flange defining the sides of a rectangular opening within said base;

an upright anchor bracket upon and at one end of said top flange on one side of said base, having a mount aperture therethrough;

a manually actuated hydraulic pump having an elongated cylindrical body;

a mount boss projecting axially of one end of said body projecting through said anchor bracket and secured thereto;

said body spanning said base and at its other end supported upon said top flange on the opposite side of said base;

said pump having a pressure fluid outlet;

an upright clamp assembly upon and at the opposite end of said top flange on said one side of said base;

said clamp assembly including a saddle upon and secured to said top flange having an upwardly opening semi-circular slot;

a pressure cap overlying and spaced above said saddle having a downwardly opening semi-circular slot;

a resilient sleeve extending transversely through said clamp assembly and nested within said saddle and pressure cap;

a swaging tool having a cylindrical body and having a pressure fluid inlet and a swaging head, said tool body axially nested within said sleeve and clamp assembly;

means for adjustably securing said pressure cap to said saddle frictionally anchoring said swaging tool body;

and a conduit fluidly interconnecting said pump outlet and said swaging tool inlet.

7. In the holder of claim 1, said sleeve being made of resilient materials.

8. In the holder of claim 1, said pump body at its other end having a rubber foot yieldably bearing upon said base.

9. In the holder of claim 1, said swaging head having the end of the tube onto which a fitting ferrule assembly is to be swaged axially projected into said swaging head, sumultaneous manual operation of said pump delivering pressure fluid to said swaging head body, said head compressably swaging said ferrule assembly onto said tube.

* * * * *